US007322913B2

(12) United States Patent
Gates

(10) Patent No.: US 7,322,913 B2
(45) Date of Patent: Jan. 29, 2008

(54) COMPACT FUNCTIONAL TRAINING BENCH

(76) Inventor: Todd Gates, 395 Grand Ave., Lindenhurst, NY (US) 11757

( * ) Notice: Subject to any disclaimer, the term of this patent is extended or adjusted under 35 U.S.C. 154(b) by 0 days.

(21) Appl. No.: 11/421,096

(22) Filed: May 31, 2006

(65) Prior Publication Data

US 2007/0281841 A1 Dec. 6, 2007

(51) Int. Cl.
*A63B 26/00* (2006.01)

(52) U.S. Cl. ..... 482/142

(58) Field of Classification Search ..... 482/142; D21/676, 686, 690
See application file for complete search history.

(56) References Cited

U.S. PATENT DOCUMENTS

| | | | | |
|---|---|---|---|---|
| 5,141,480 | A * | 8/1992 | Lennox et al. | 482/104 |
| 5,445,583 | A * | 8/1995 | Habing | 482/52 |
| 6,398,699 | B1 * | 6/2002 | Yang | 482/142 |
| 6,659,923 | B2 * | 12/2003 | Teuscher | 482/142 |
| 6,966,872 | B2 * | 11/2005 | Eschenbach | 482/142 |
| 7,083,558 | B2 * | 8/2006 | Williams, Sr. | 482/142 |
| 7,087,005 | B2 * | 8/2006 | Rouillard | 482/142 |
| 7,160,234 | B2 * | 1/2007 | Dise | 482/142 |
| 2002/0151419 | A1 * | 10/2002 | Barnes et al. | 482/142 |
| 2003/0050157 | A1 * | 3/2003 | Teuscher | 482/142 |
| 2004/0198572 | A1 * | 10/2004 | Rouillard | 482/142 |
| 2005/0003937 | A1 * | 1/2005 | Chen | 482/104 |
| 2005/0049124 | A1 * | 3/2005 | Xieh | 482/142 |
| 2006/0035772 | A1 * | 2/2006 | Golesh et al. | 482/142 |
| 2006/0122045 | A1 * | 6/2006 | Webber | 482/142 |
| 2006/0217249 | A1 * | 9/2006 | Webber | 482/142 |

* cited by examiner

*Primary Examiner*—Lori Amerson
(74) *Attorney, Agent, or Firm*—Millen, White, Zelano & Branigan, P.C.

(57) ABSTRACT

A compact functional training bench able to support a user performing upper and lower body exercises is comprised of a base, a seat, a main and adjustable support column, and a pivoting support plate with angular adjustments. The bench has multiple vertical height adjustments independent of the seats' incline adjustments. All seat angles support a user's upper torso, lower torso or entire body. The present design is light weight, simple and practical. The use of ergonomics was a basis for the present invention. Many types of people are able to use the compact functional training bench regardless of their, height, size or exercise level.

7 Claims, 7 Drawing Sheets

COMPACT FUNCTIONAL TRAINING BENCH

FIELD OF INVENTION

This invention relates to the field of strength and conditioning equipment for home fitness, portable fitness, or gym fitness equipment.

BACKGROUND OF INVENTION

Traditional exercise benches are large and cumbersome. They are limited in function and are not feasible for home use unless a person has enough space. They also have limited capability for strength and conditioning coaches and athletes because they are not versatile. They are designed to function as an upper body exercise apparatus. None of them adjust vertically and are cable of performing a multitude of lower body exercises correctly. Exercise benches are not built to fully meet the needs of athletes (professional and amateur), fitness devotees, professional trainers, and anyone truly interested in optimum true-form exercise performance. They are made for an average sized person and do not take into consideration the many different sizes and performance requirements of people utilizing them. Exercise benches are widely used in home gyms, health clubs, training centers, and university weight rooms. Often there is a tremendous wait to use one because of the time it takes for the users to try to adjust the benches to fit their body size and type of exercise they are performing.

Athletes and fitness devotees train differently than the average person. These advanced users depend upon perfect form, proper sizing (height ratio to body size, strength, and range of motion), isolated muscle movement, safe equipment, and immediate flexibility. This means they need unique and different training resources than currently available. The health and fitness industry does not always address these consumer's needs or think how a strength and conditioning coach thinks. Strength coaches create programs with the limited-function equipment that have already been provided to them. They make adjustments according to their less than optimum resources. There are innovative ideas in the field of strength and conditioning, but more thoughtful exercise equipment for athletes and fitness devotees would provide a much needed resource for optimum exercise and training.

There are currently no compact functional exercise benches evident on the market that can be utilized for strength and conditioning coaches, gym training, and home fitness. Furthermore, all current exercise benches are relatively heavy and do not adjust vertically in height and length.

Since the typical exercise bench has no height adjustments, exercise variations are limited. A tall person's relationship to an exercise bench is different from a shorter person's relationship. Therefore, many exercises are not optimal for either person. In order to alleviate this problem, a person must either choose a different apparatus, abandon the particular exercise altogether, or perform it incorrectly (which has many negative effects). For example the proper form when performing a "box-squat to parallel" on an exercise bench is determined by the height of an individual. "Parallel location" for a person who is 6' feet tall is different than for a person who is 5'6" tall. The exercise will never be performed correctly if the height of the bench cannot be adjusted.

The typical exercise bench is limited to mostly upper body exercises because they have a standard height with no vertical adjustments. There are many types of exercises such as, squats, step-ups and explosive lower body movements that cannot be performed on a typical exercise bench effectively because of its limitations. As mentioned above these exercises are limited in their effectiveness and functionality due to the various heights of the people performing them.

Many people would like to work out in the comforts of their home but do not have the space for an exercise bench. Also, people who are just starting a workout program might be intimidated going to a gym and would rather start at home to build up their self confidence. The problem with purchasing an exercise bench to use at home is, once you are dorie working out, where are you going to put it if you do not have an exercise room? Exercise benches are not made for apartments or small homes. They are purchased for home use by people who have garages, basements or a workout room with plenty for space for use and/or storage.

SUMMARY OF INVENTION

The present invention takes the traditional bench and looks at it from a functional standpoint. Adding greater functionality eliminates all the limitations that the traditional bench has. Said bench is comprised of a breathable foam seat cushion (like BrockUSA™ branded open celled foam) that may or may not be covered with an equally breathable and cleanable synthetic covering.

A pivoting structural square (uniformly dimensional) plate with multiple angular seat adjustment holes supports the attached seat cushion. The plate attaches to the top of the inner support column to hold the assembly in position.

A spring-loaded quick release steel pin is used for angular seat adjustment. Once the desired angle of the seat is chosen, the quick release pin is placed through the hole and locks the seat into position.

A main and inner support column is constructed with the vertical seat height adjustment holes. The main support column holds the inner support column in place when the seat is adjusted to the desired height.

A quick pin is attached to the main support column to lock in the desired seat height by moving the inner shaft up or down.

A structural base supports the seating assembly. The main support column is attached to the axis of the steel base.

Padded rubber feet attach to the legs of the base for lateral stability. Since the rubber feet do not adjust up or down (too much complexity for the user), one option is a three-point base for optimal stability on an uneven floor.

The following procedures and methodologies that describe, but are not limited to the proper way to use this product for optimum performance.

The neutral position in reference to said seat is when said seat angle is parallel in relation to the floor.

The following procedure is the correct way to adjust the compact functional training bench to perform a "box-squat to parallel". Adjust the inner support column by releasing the quick pin to either raise or lower the support column to a height when said user squats down and reaches the bottom part of the movement said users' femur is parallel in relation to the floor. Adjust the seat to the neutral position by removing the quick release pin. Straddle said center of seat with the left foot on one side and the right foot on the other side. Squat down slowly until your gluteus touches said seat then rise back up to the starting position.

The following procedure is the correct way to adjust the compact functional training bench to perform a "High Box Step-Up". Adjust the inner support column by releasing the quick pin to raise said seat to a position that is located at mid-thigh of said user while said user is standing in an upright position. Adjust said seat to the neutral position. Place one foot on said seat above the axis of said support column. Position the other foot on the floor slightly away from said compact functional training bench where said user is in a full upright position.

The following procedure is the correct way to adjust the compact functional training bench to perform an "Incline Stability Press". Adjust the inner support column by releasing the quick pin to position the support column at a height where said user can support their upper back against the seat while using their legs as support to stabilize their body. Adjust said seat to a 45 or 30 degree angle by removing the quick release pin and raising the seat from the neutral position to the prescribed angle. Reinsert said quick release pin horizontally once the angle is achieved.

The following procedure is the correct way to adjust the compact functional training bench to perform "Prone Positioned Y's & T's" for the Rotator Cuff. Adjust the inner support column by releasing the quick pin to position the support column to a height where said user is in a prone position on the seat with arms fully extended towards the ground.

The following procedure is the correct way to adjust the compact functional training bench to perform "Parallel Static Bench Jumps". Adjust the inner support column to height where said user sits on the seat said user legs are parallel in relation to the floor. Adjust said seat to the neutral position.

The following procedure is the correct way to adjust the compact functional training bench to perform "Band Military Press". Adjust the inner support column to height where said user sits on the seat said user legs are parallel in relation to the floor. Adjust said seat to the neutral position. Attach tubing to brackets located on the

BRIEF DESCRIPTIONS OF THE DRAWINGS

DETAILED DESCRIPTION OF PREFERRED EMBODIMENT

It should be uniformly understood the following detailed descriptions of the present inventions components below illustrated in the figures as generally described below does not limit the current design. The current representation is one of several ways the present invention could be designed. Therefore, the preferred embodiments are intended to only illustrate the present invention and not limit the scope or future designs.

Figure 1:
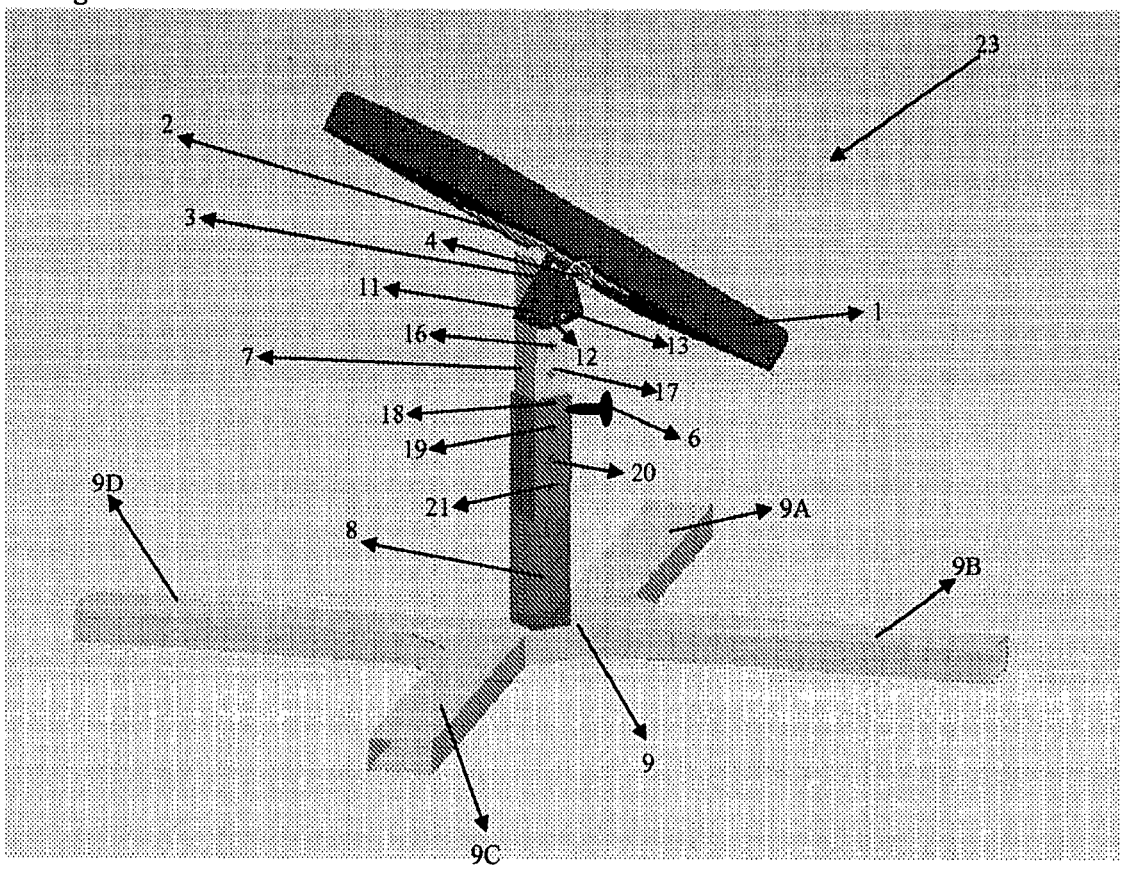
FIG. 1 shows a side view of the complete assembly of the compact functional training bench.
Figure 4:
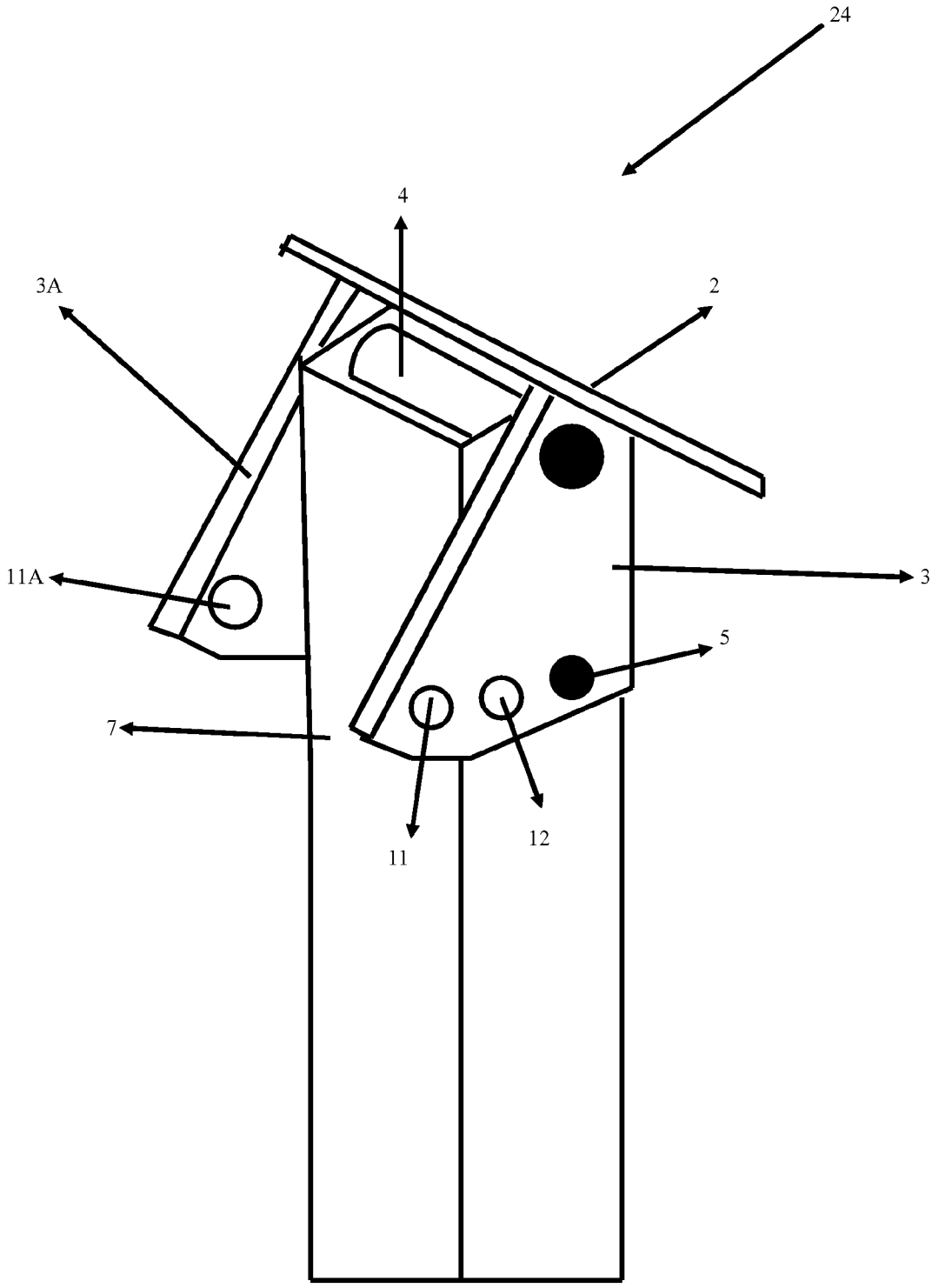
FIG. 4 shows a front view of the pivot plate assembly system with locking pins and outer support column.
Figure 5:
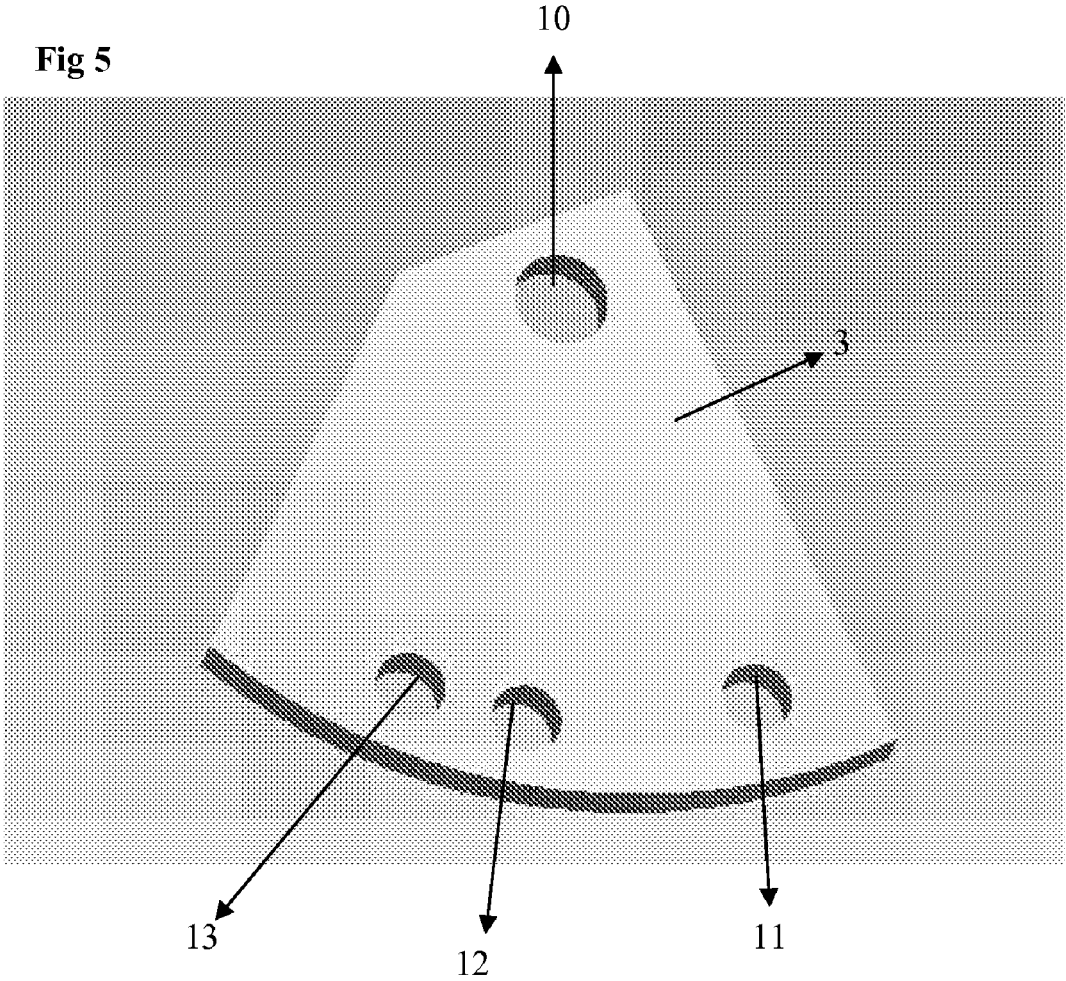
FIG. 5 shows a close up side view of the pivot joint with quick release pin holes.

Referring to the drawings in more detail in FIGS. 1 and 4. The compact functional training bench 23 is comprised of a sturdy base axis 9 with legs 9A-9D extending away from the axis at a 45 degree angle. A main support column 8 with a weld in pin 6 is connected to the base axis 9. An inner support column 7, which slides up and down in the main support column 8. The inner support column 7 has multiple vertical seat height adjustment holes 16-21 and supports the pivot plate assembly system 24. A pivot joint 3 and 3A adjust the seat 1 angle. The pivot joints 3 and 3A have quick release pin holes 11-13 to set the desired seat 1 angle. There is a locking pin hole 10 for a locking pin 4 to secure said seat assembly 24 to said inner support column 7. The locking pin 4 secures seat 1 horizontally through a locking pin hole 10.

In the illustrated embodiment the design of the invention has many benefits. Since a user's whole body is not designed to fit on said seat 1, a user must utilize the stabilizing muscles of their abdominals and lower torso to stabilize their body when lying in the prone or supine position. Utilizing stabilizing muscles increases proprioreception and improves core strength. This type of training also teaches users' to activate their transverse abdominus which is a very important muscle for spinal stabilization and overall core strength. The present invention is a viable alternative for users' who are not strong or stable enough to exercise on a stability ball (e.g. Perform Better or Power Systems). Exercising on a stability ball takes enormous core strength and focus. A person who is at the intermediate or beginner's stage of training or even rehabilitating an injury can use the compact functional training bench as a progression towards using a stability ball once they have mastered exercises on the bench.

Base

Figure 3:
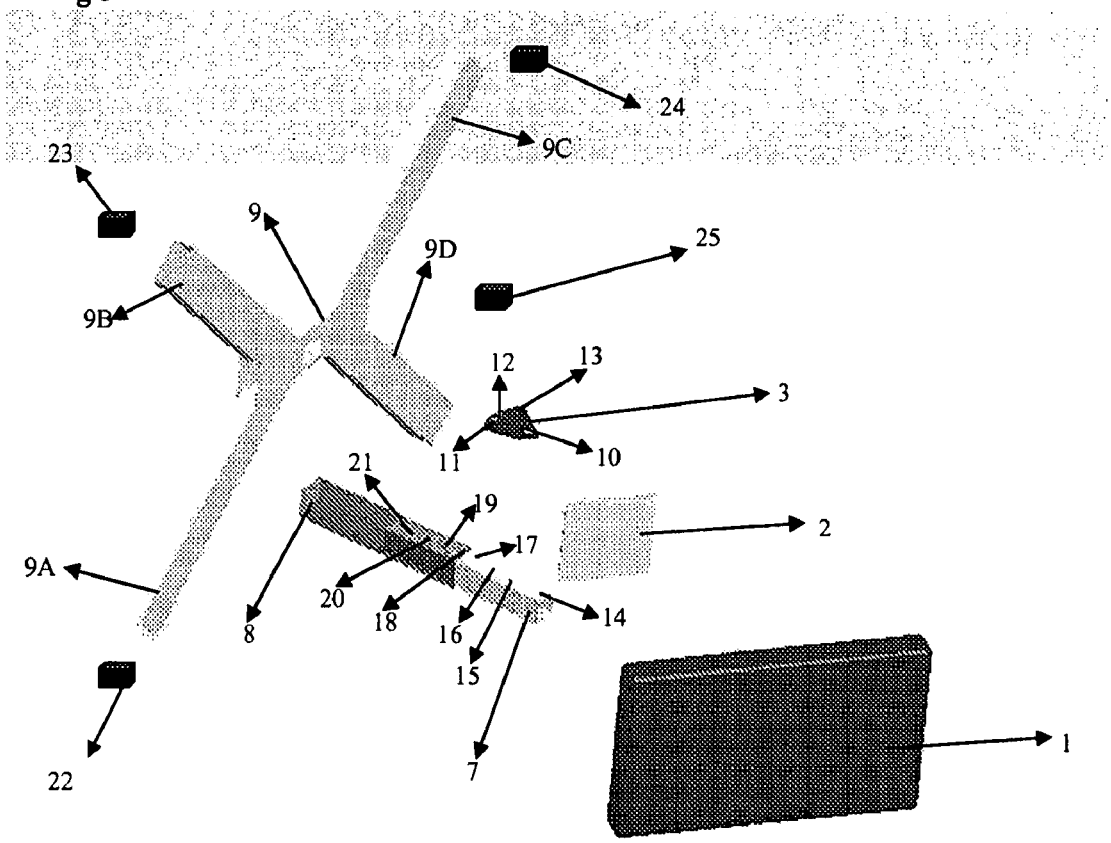
FIG. 3 shows an exploded view of the compact functional training bench.

In reference to FIG. 1 and FIG. 3 the base 25 has a base axis 9 and legs 9A-9D. It can be comprised of any sturdy material such as metal, alloy, steel, aluminum or plastic composite. The present invention uses steel for the base 25. The base's legs 9A-9D are solid and are configured to extend away from the base axis 9 at a 45 degree angle. The current design has an X-shape. Other designs such as T or L shaped legs can be considered as alternatives for constructing the base. Another consideration is to have hinges on the base legs 9A-9D that allow the legs to fold under the unit when a person is ready to store it.

The base 25 design allows a user to put a band underneath the base axis 9 and then perform upper or lower body exercises. A user can easily perform various types of presses and pulls with a band. Rubber padded feet 22-25 attach to the bottom of the base legs 9A-9D to insure lateral stability and protection from scratching wood based surfaces.

The X-design enables a user who is performing upper or lower body exercises to comfortably place their feet on the floor on the inside or outside of the base 25. A user can align their feet in the proper body position to insure proper technique is used when exercising. This is imperative when performing exercises.

Main and Inner Support Column

Figure 6:
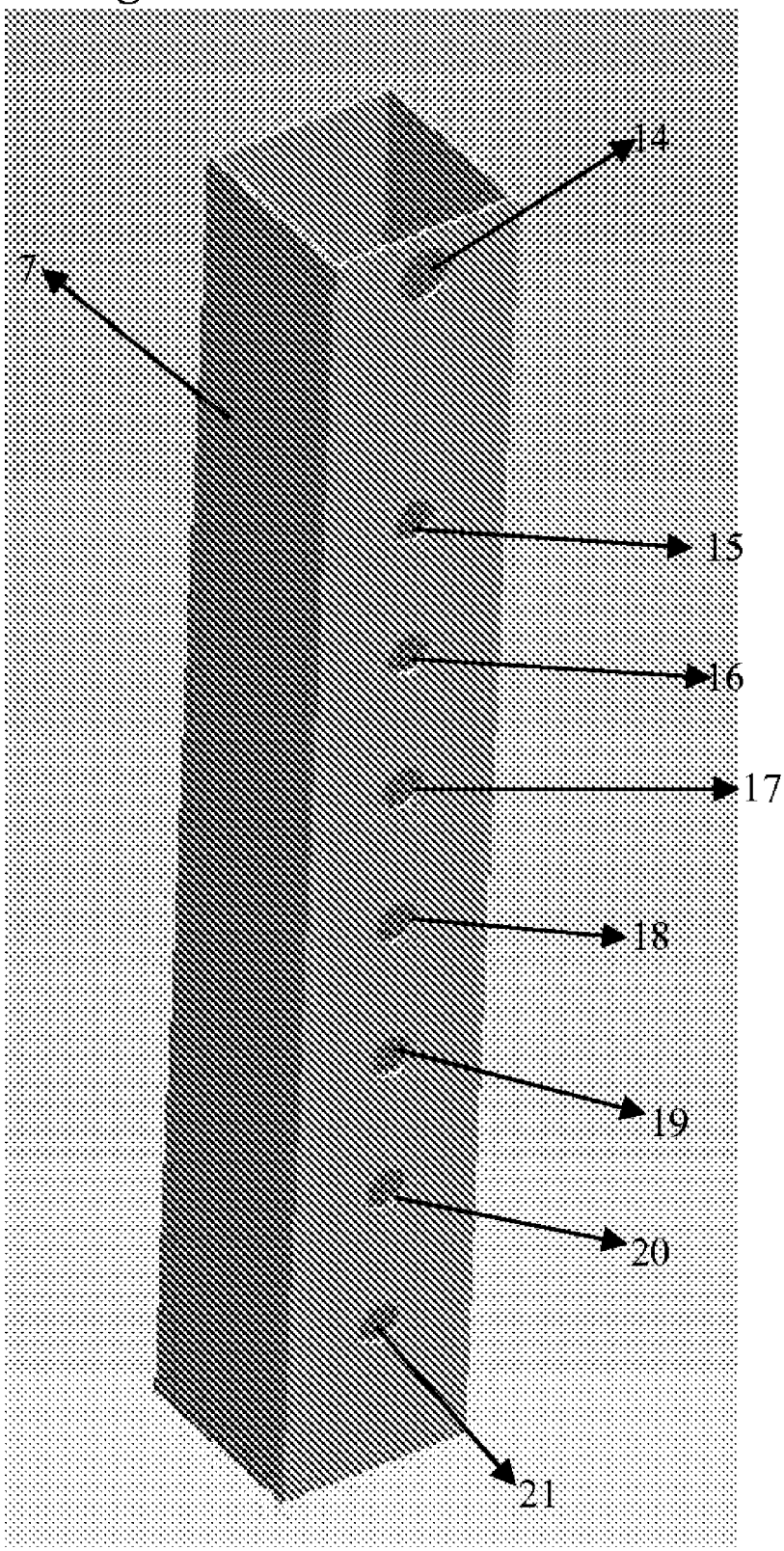
FIG. 6 shows the front view of the inner support column with a locking pin hole, quick release pin hole and vertical seat height adjustment holes.
Figure 7:
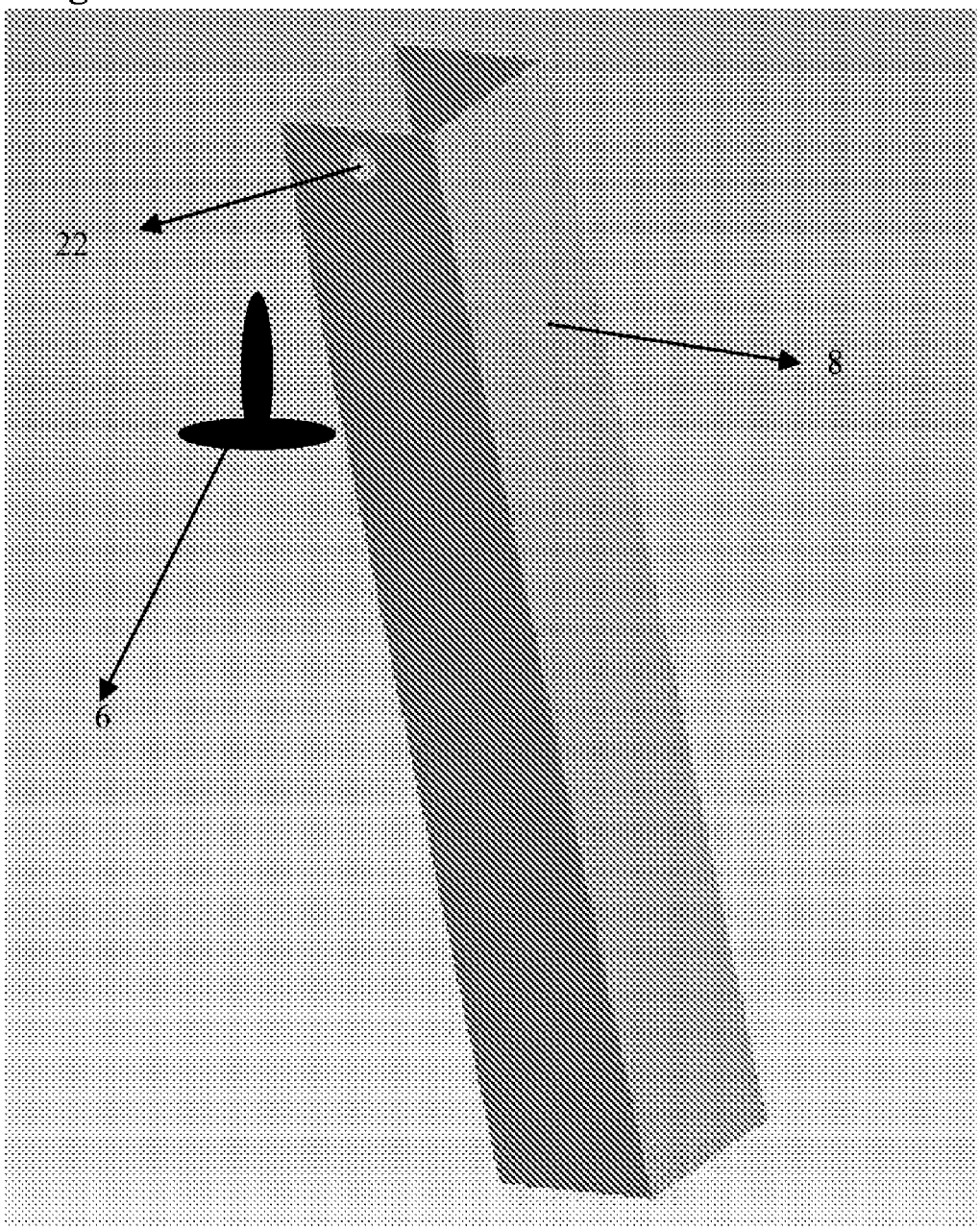
FIG. 7 shows a front view of the main support column and hole for weld in pin to lock in seat height when inner support column is inserted into the main support column.

In reference to FIGS. 3, 6 and 7 the main support column 8 attaches to the base axis 9. The main support column 8 is constructed of steel for the present invention. Any suitable material strong enough to support a user or heavy weighted load can be used to construct the main support column 8 such as, metal alloy, aluminum, plastic or plastic composite. The main support column 8 has a weld in pin hole 22 for a weld in pin 6. The Weld in pin 6 secures the seat height to the inner support column in FIG. 1. It is a basic spring loaded pull pin that easily pulls out and then locks back. It is recommended a steel pin be used if one is considering using heavy loads on the bench to exercise.

In the illustrated embodiment the main support column 8 for the present invention is welded to the base axis 9. One might also consider putting a hinge on the main support column that would allow it to collapse downward for easy storage.

In the illustrated embodiment the inner support column 7 slides up and down in the main support column 8. The maximum height the inner support column 7 can be adjusted to. The ability for a user to adjust the apparatus vertically is a unique design only found on the present invention.

In the illustrated embodiment the inner support column 7 has vertical seat height adjustment holes 16-21. These add to the ergonomics of the present invention. Regardless of a person height or size, the compact functional training bench can adjust to fit a user's height and needs. This creates safe effective exercises and comfort when working out. Being in the right body position insures a safe full range of motion when exercises which maximizes the health benefits of working out.

In the illustrated embodiment, inner support column 7 versatility along with the pivot plate assembly system 24 is especially important for athletes, physical therapist and strength coaches. A subtle change in positioning during exercise allows different muscles to be recruited or isolated. This enables physical therapists and strength coaches to correct postural inadequacies during corrective exercises or movements.

Professional and collegiate athletes who train differently from the normal population have to maintain postural integrity during exercise. Postural integrity insures proper body mechanics and proper muscles are being recruited during exercise. Muscular imbalances can lead to injury which inhibits an athlete's performance.

Improper technique while exercising due to insufficient equipment decreases the effectiveness of exercises. For example, a 6'10 basketball player performing a single leg squat on a standard exercise bench will have a harder time stabilizing their body because the bench seat is too low. This can either cause an injury or poor technique. The compact functional training bench 23 addresses that issue because the inner support column 7 can be raised to the proper height for an athlete who is tall.

Pivot Assembly System

In reference to FIG. 1 and FIG. 4, said pivot plate assembly system 24 has a quick release pin 5 which is easily removed and a locking pin 4 which secures the entire unit. The present invention has three different seat 1 angles. The quick release pin holes 11-13 are located on pivot joint 3 and 3A. A user has the option to secure said seat 1 in said neutral position 11, said 30 degree angle 12 or said 45 degree angle 13 to perform lower and upper body exercises.

In the illustrated embodiment the ability to change said seat 1 angles increases the versatility of the compact functional training bench 23. The other added benefit is the bench can be configured to a user's personal preference. A person who is tall performing supine stability incline press can adjust said inner support column 7 height to position 6 because of the ergonomic fit. Standard benches do not have that option.

In the illustrated embodiment said pivot joint 3 and 3A have three quick release pin holes 11-13 and 11A. Quick release pin 5 for example extends horizontally through quick release pin hole 11 and 11A which sets said seat 1 angle to the neutral position. Quick release pin hole 12 sets said seat 1 angle to 30 degrees and quick release pin hole 13 sets said seat 1 angle to 45 degrees. The advantage of having said seat 1 at different angles is users are able to perform many different exercises from different body positions. Because said pivot plate assembly system 24 works independently from said inner support column 7. This allows different size user's to perform the same exercises at the proper position for their size and height. This insures the user is getting maximum benefit out of the exercise.

For instance, when said seat 1 is in quick release pin hole 11 and position 419 (intermediate height position), a shorter person can perform a supine stability dumbbell bench press and a supine hip extension then immediately raise the inner support column 7 to position 6 (the highest seat height position) for a very tall person to perform the identical exercise. Both people will benefit equally from the exercise because they are in correct body positions in relation to the bench. The versatility of the compact functional training bench allows user's to super set their exercises on one station; hence this lessens the need for additional equipment to get a total body workout.

In the illustrated embodiment user's who live in apartments, town houses, condominiums or do not have space in their house for multiple pieces of equipment can still get a quality total body workout with the compact functional training bench 23. It does not take up space and the lightweight design enables it to be moved easily. Exercise bands with handles, dumbbells or your own body weight (e.g. Fit Tube and York Barbell) can be used. The ability to adjust the height with said inner support column 7 and said pivot plate assembly system 24 gives the compact functional training bench all the versatility needed to train your entire body.

Seat

Figure 2:
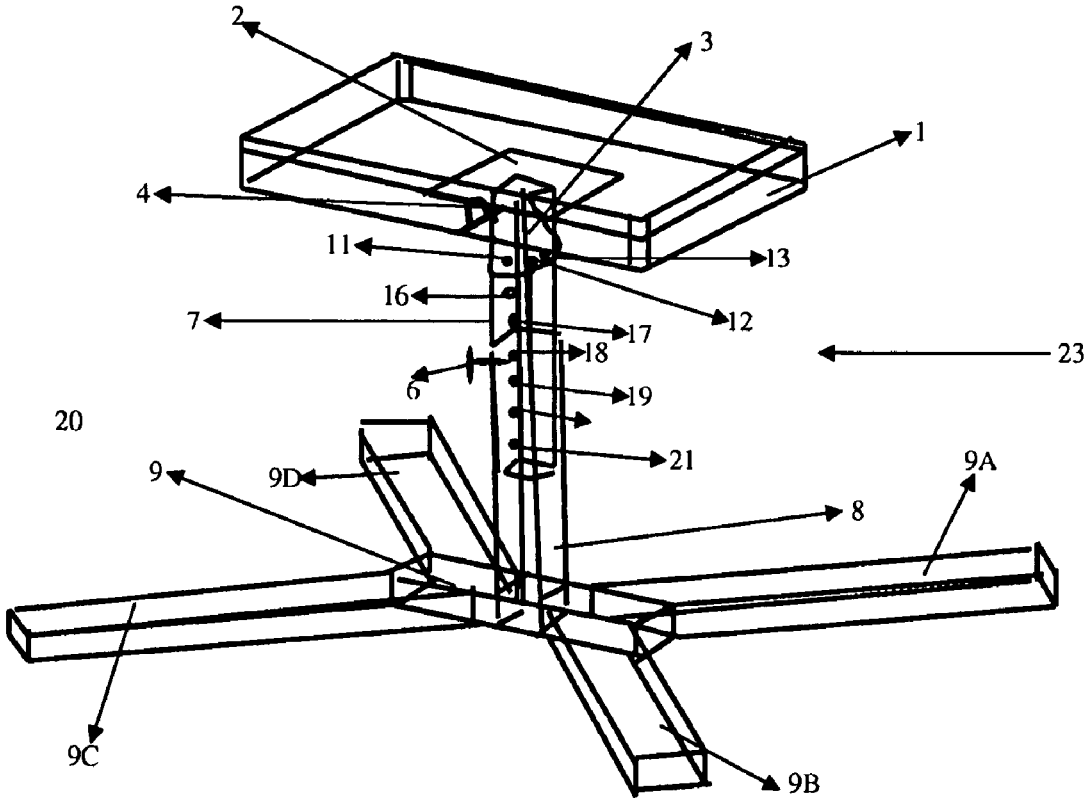
FIG. 2 shows a side view of a complete wire assembly of the compact functional training bench.

In reference to FIGS. 1 and 2 the seat 1 is secured to the mounting plate 2 with screws (not shown). Seat 1 can be comprised of any breathable or non breathable material such as leather or vinyl. The material is strong enough to maintain consistency with the ergonomic design of the compact functional training bench. Said seat 1 only pivots downward to create an incline position. One skilled in the art could devise said seat 1 to pivot in both directions to add to the versatility. The surface area is large enough to support any size person able to use the apparatus. The strength and durability of the seat 1 allows user's to stand, jump, step up or lay in the prone or supine position.

In the illustrated embodiment the seat 1 can be manipulated to perform a number of exercises from neutral position 11. Such as; seated over head presses, supine dumbbell presses, body weight step-ups and prone position reverse hypers. Said seat 1 height would be determined by the size of the user and what type of exercise being performed. In the incline position a user can perform plyometric pushups or modified pushups on seat 1. The present design is excellent for performing exercises for the rear deltoids, rotator cuff and rhomboids. Lying prone on said seat 1 using your legs as support a user can hold dumbbell, cables or bands and have free range of motion. Said base 25 design and pivot plate assembly system 24 do not have anything inhibiting a user's movement such as; bulky knobs, locking bars or the base itself.

It should be noted the following embodiments above describing and illustrating the functions of said invention should by no means be interpreted as the only manner to configure the present invention. In fact, anyone skilled in the art could foresee a multitude of ways to configure the preferred embodiment. Therefore, the claims set forth are not intended to be restrictive or limit the scope of the invention. Those skilled in the art and have ability to acquaint oneself with said elemental concept can manipulate the present embodiment as well as other embodiments with amendments and modifications. Hence, all related amendments and modifications to the invention are so represented in the above claims.

What is claimed:

1. A training bench comprising a base support from which a vertical axis extends;

a compact high density seat pad spaced from the base support to support a user in a prone or supine position thereupon when exercising, an adjustable mounting plate for securing the seat pad to be secured to a pivoting structural joint, the pivoting structural joint having multiple angular adjustment holes, wherein said pivoting structural joint deploys vertically and horizontally into neutral and multiple angular positions, a main support column secured to said base support and an inner support column within the inner support column with vertical pin adjustment holes supported by said main support column, said inner support column being movable vertically along said axis within the main support column, a first removable locking arrangement pivotally connecting said pivoting structural joint to said inner support column, a second removable locking arrangement connecting to said pivoting structural joint to said inner support column for multiple angular adjustments of the pivoting structural joint and thus the seat pad with respect to the vertical axis, a weld-in pin connected horizontally to said side of said main support column to secure the vertical position of said inner support column with respect to the main support column and thus the vertical seat height adjustment, and a structural base support extending from said base support defined by two legs extending forward from said axis and two legs extending rearward of said axis.

2. The training bench as claimed in claim 1, wherein said seat pad is set at said multiple angular positions by removing a pin of the locking arrangement and lowering said seat pad into a quick release pin hole position.

3. The training bench as claimed in claim 1, wherein said removable locking system secures said pivot assembly system by a pin inserted horizontally through said pivot joint hole and said inner support column hole.

4. The training bench as claimed in claim 1, wherein said removable inner support column is supported by said main support column, said main support column being configured to hold said inner support column as said inner support column deploys vertically in a frontal plane.

5. The training bench as claimed in claim 4, wherein said main support column secures said removable inner support column in a chosen vertical height position with said weld-in pin attached horizontally to said main support column and extending horizontally through vertical pin holes located on said inner support column.

6. The training bench as claimed in claim 1, wherein the legs of said structural base support structure extend horizontally in a sagittal plane away from said base axis.

7. The training bench as claimed in claim 1, wherein said structural base support has rubber feet attached thereto for lateral stability and inertia resistance.

* * * * *